United States Patent [19]

Huffman et al.

[11] 4,065,081

[45] Dec. 27, 1977

[54] ALTERNATING CURRENT TRACK CIRCUITS

[75] Inventors: Jerry P. Huffman, Churchville; John P. LaForest, Conesus; William A. Petit, Rochester; James A. Smith, Conesus, all of N.Y.

[73] Assignee: General Signal Corporation, Rochester, N.Y.

[21] Appl. No.: 749,144

[22] Filed: Dec. 9, 1976

[51] Int. Cl.[2] ..... B61L 23/16

[52] U.S. Cl. ..... 246/34 R; 246/63 C

[58] Field of Search ..... 246/34 R, 34 B, 34 C, 246/34 CT, 40, 63 R, 63 C, 122 R, 187 B

[56] References Cited

U.S. PATENT DOCUMENTS

| | | | |
|---|---|---|---|
| 3,270,199 | 8/1966 | Smith | 246/187 B X |
| 3,339,067 | 8/1967 | Reich | 246/34 R |
| 3,986,691 | 10/1976 | Ehrlich et al. | 246/34 R |

FOREIGN PATENT DOCUMENTS

| | | | |
|---|---|---|---|
| 1,152,133 | 8/1963 | Germany | 246/34 R |

*Primary Examiner*—Stephen G. Kunin
*Attorney, Agent, or Firm*—Harold S. Wynn

[57] ABSTRACT

Alternating current track circuits are provided for the several adjoining track sections of a stretch of railway track, each of the track circuits comprising an alternating current code transmitter and an alternating current code receiver connected to track rails at opposite ends of the associated section. Circuit apparatus including an alternating current line circuit extending along the stretch of railway track is provided for normally communicating alternating current from the line circuit through rails of the associated track sections, the alternating current being modulated at a selected rate code and current in any two adjoining track sections being of opposite instantaneous polarity for broken down joint protection. Phase sensing apparatus is provided at a receiving end of each track section including a comparator for comparing the rate code modulated alternating current communicated through the track rails with a steady reference source connected to the line circuit. A system including a flip-flop circuit and a low pass filter is provided for energizing a track relay only in response to a distinctive output of the comparator indicative of proper phase relationship of the current in the associated track section.

5 Claims, 2 Drawing Figures

ALTERNATING CURRENT TRACK CIRCUITS

BACKGROUND OF THE INVENTION

Figure 1:
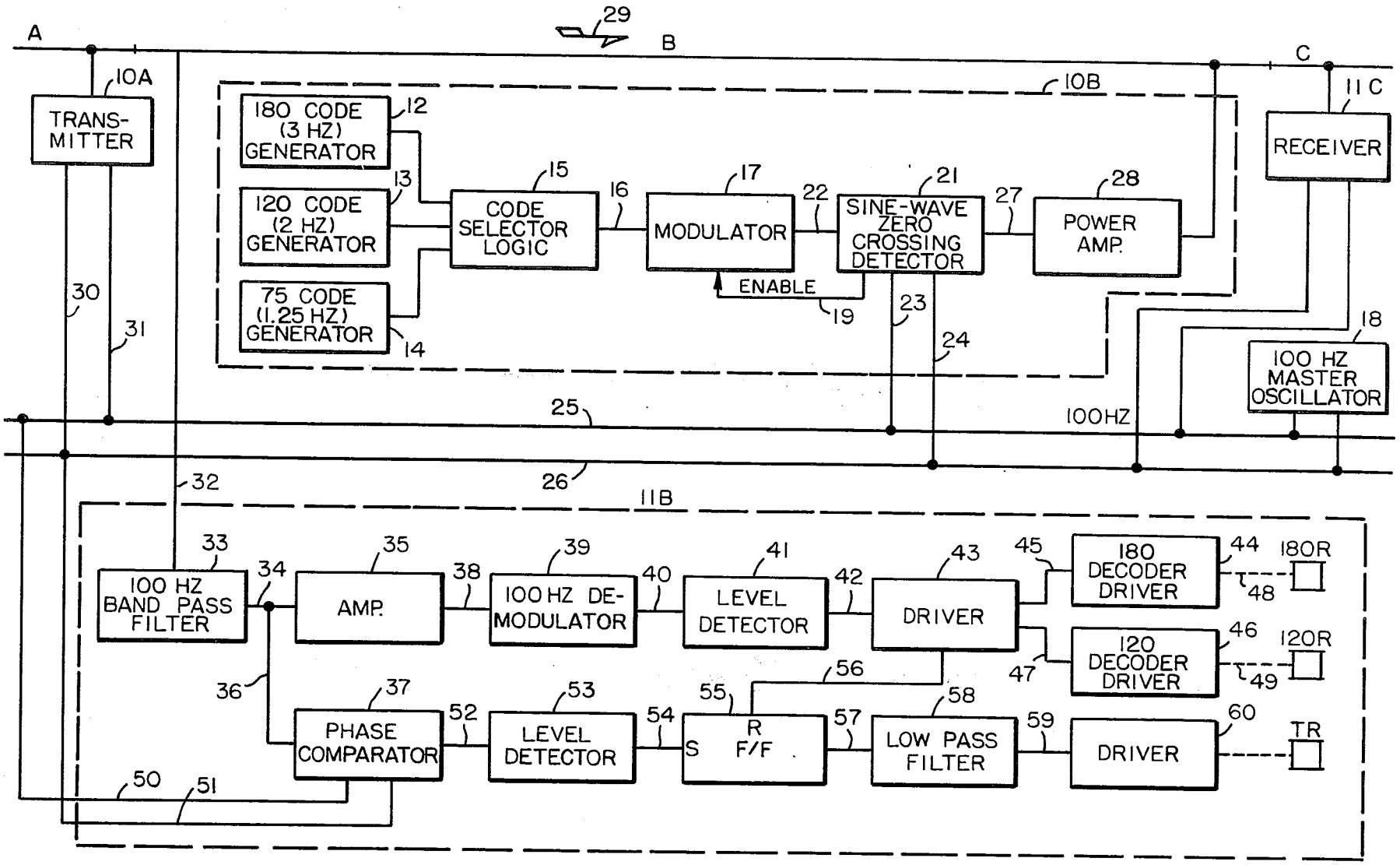

This invention relates to alternating current track circuits for railroads, and while the invention is subject to a wide range of applications, a preferred embodiment of the invention will be particularly described as applied to modulated alternating current track circuits for communicating selected signalling and train control codes through track rails for governing the passage of vehicles.

The present invention is an improvement over currently used alternating current track circuit systems of the general character disclosed in the U.S. Staples Pat. No. 2,884,516, granted Apr. 28, 1959. This patent discloses alternating current track circuits for the several adjoining track sections of a stretch of railway track, each of the track circuits comprising an alternating current code transmitter and an alternating current code receiver connected to opposite ends of the associated track section for detecting occupancy, for communicating signal control rate codes through the track rails and for detecting broken down insulated rail joints which may be used to define boundaries of the several track sections. The alternating current is generally a 100 HZ frequency which is continuously modulated by a code generator to provide time spaced square wave track circuit pulses of 100 HZ alternating current at selected rates of 75, 120 or 180 time spaced pulses per minute. The generating of the square wave pulses tends to generate undesirable harmonics, and the relatively slow 75 rate code is difficult to decode. Phases of the adjoining track circuits are staggered in order to guard against broken down insulated rail joints.

An object of the present invention is to provide alternating current track circuits for the several adjoining track sections of a stretch of railway track having improvements which substantially obviate one or more of the limitations and disadvantages of the described prior systems.

Another object of the present invention is to provide improved means for broken down joint protection.

Another object of the present invention is to reduce to a minimum the generation of harmonic frequencies in generating square wave pulses for communication through the track rails.

Other objects, purposes and characteristic features of the present invention will be in part obvious from the accompanying drawings, and in part pointed out as the description of the invention progresses.

SUMMARY OF THE INVENTION

Alternating current track circuits are provided for the several adjoining track sections of a stretch of railway track, each of the track circuits comprising an alternating current code transmitter and alternating current code receiver connected to track rails at opposite ends of the associated section for occupancy detection, for communicating signal control rate codes through the track rails and for detecting broken down insulated rail joints which may be used to define boundaries of the several track sections. An improved track circuit for each of the track sections comprises an alternating current line extending along the stretch of railway track feeding code transmitting apparatus for normally communicating alternating current from the line circuit at a selected modulated rate code through rails of the associated track sections, current in any two adjoining track sections being of opposite instantaneous polarity for broken down joint protection. Receiving apparatus is provided for each of the track circuits responsive to the coded alternating current communicated through the track rails for governing energization of a track relay. This apparatus comprises phase sensing apparatus having a comparator for comparing the rate code modulated alternating current communicated through the track rails with a steady reference source connected to a line circuit, and for generating an output rate code pattern comparable to modulations in the track rails, only provided that the alternating current in the track rails is substantially 180° out of phase with the reference source of the associated track circuit. Apparatus including a low pass filter provides that the track relay can be energized only in response to an output of the comparator indicative of reception of alternating current through the track rails of the phase assigned to the associated track section.

Code modulation of the 100 HZ power supplied to the track circuit is accomplished by use of a zero crossing detector to turn the code pulse on and off only at the zero crossing times of the alternating current supply, thus reducing the generation of electronic noise to a minimum.

For a better understanding of the present invention, together with other and further objects thereof, reference is had to the following description, taken in conjunction with the accompanying drawings, while its scope will be pointed out in the appending claims.

Figure 2:
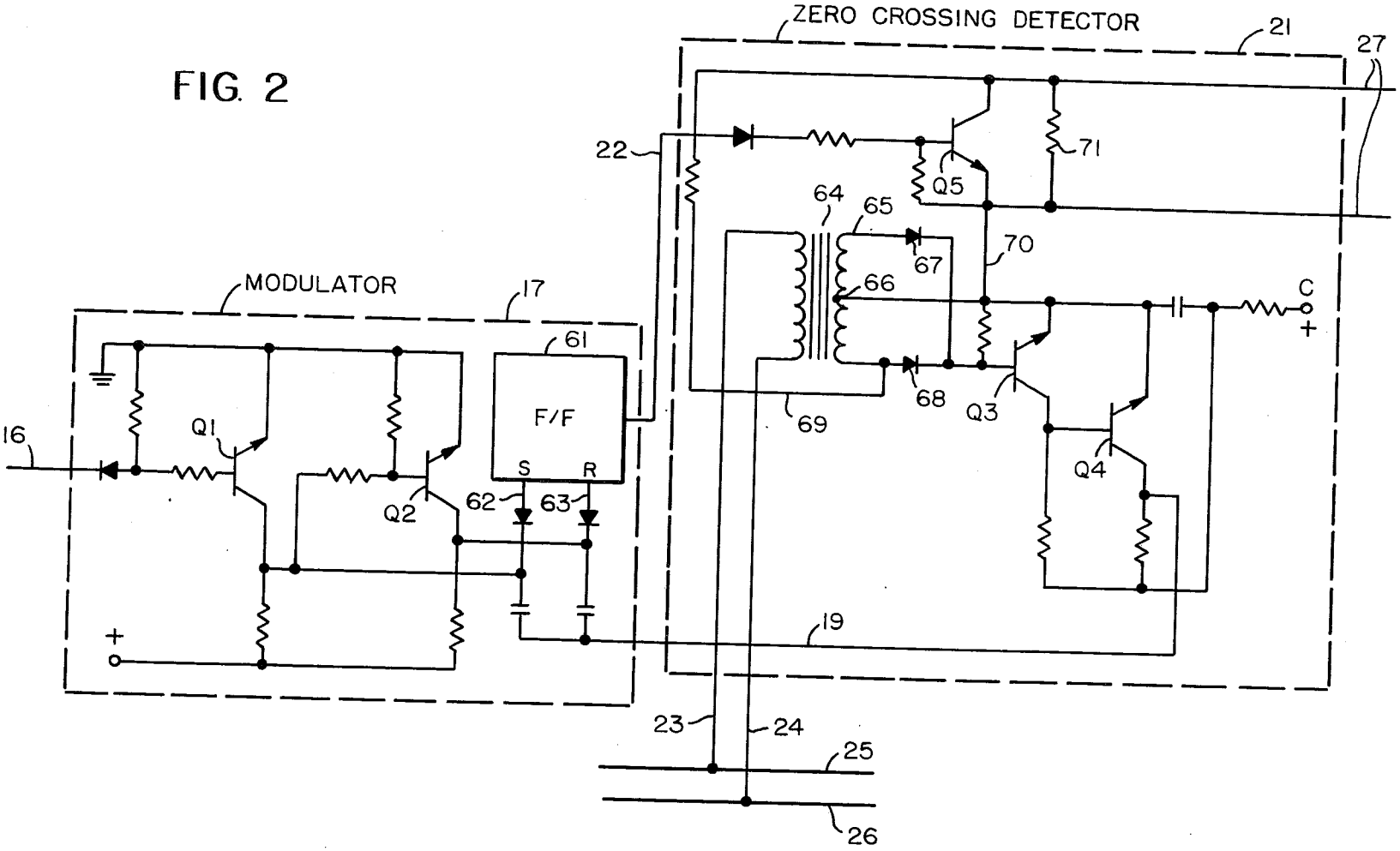

In the accompanying drawings:

FIG. 1 is a block diagram of an alternating current track circuit system for a stretch of railway track according to a preferred embodiment of the present invention; and FIG. 2 shows specific circuits of a modulator and a zero crossing detector shown in FIG. 1.

With reference to FIG. 1, alternating current track circuits are provided for the several adjoining track sections A, B and C of a stretch of railway track. Track circuit code transmitters 10A and 10B are illustrated as being connected to the right-hand ends of track sections A and B respectively and alternating current code receivers 11B and 11C are illustrated as being connected to the left-hand ends of track sections B and C for receiving codes communicated through the associated track sections. The code transmitter 10B for the typical track section B comprises a plurality of rate code generators such as generators 12, 13 and 14 for generating 180, 120 and 75 rate codes respectively. Code selector logic 15 is provided for selecting one of the rate codes for transmission in accordance with desired communication for signalling purposes and the like, this selector 15 generating an output according to the rate code selected which is applied over line 16 to a modulator 17. The modulator 17 generates an output on line 22 turned on and off at the rate code selected, the switching taking place at zero A.C. wave crossing times as enabled over line 19 by a sine-wave zero crossing detector 21.

The output of modulator 17 as applied over line 22 to the sine-wave zero crossing detector 21 pulses the 100 HZ power applied to sine-wave zero crossing detector 21 over wires 23 and 24 from line wires 25 and 26. This pulsing is at the zero crossing point of the 100 HZ power supplied to the line circuit by the 100 HZ master oscillator 18. The sine-wave zero crossing detector 21 therefore delivers an alternating current rate modulated output on line 27 that is applied through a power amplifier 28 to the track rails at the righthand end of track section B. This transmits from right to left through the track section B in the desired direction for traffic proceeding from left to right (see traffic direction arrow 29). The transmitter A receives its 100 HZ energy sound from wires 30 and 31 connected to line wires 25 and 26 so as to be of opposite instantaneous polarity relative to the 100 HZ energy of transmitter 10B for the adjoining track section B. This is for broken down joint protection as will be discussed more in detail.

The code receiver 11B is connected over line 32 to the left-hand end of track section B for receiving rate codes communicated through the track rails of this track section. Input to receiver 11B is applied through a 100 HZ band-pass filter 33 over line 34 to an amplifier 35, and also over a line 36 to a phase comparator 37. Output of amplifier 35 is applied over line 38 to a 100 HZ demodulator 39 where the alternating current component is removed and the modulation rate code is recovered and is applied to line 40 as an input to a level detector 41. If amplitude of input to level detector 41 is sufficient to be indicative of an unoccupied track section, detector 41 delivers an output on line 42. The output of level detector 41 on line 42 is applied through a driver 43 to a 180 rate decoder and driver 44 over line 45, and also to a 120 rate decoder and driver 46 over line 47. The decoding of a 180 rate code energizes a 180R decoding relay over line 48, and similarly the decoding of a 120 rate code energizes a decoding relay 120R over line 49.

A circuit branch fed by line 36, checks that the energy received is properly coded and substantially in phase with the originally designated instantaneous polarity for track section B, and energizes a track relay TR, only if these conditions are met, and if the level of energy received is sufficient to be indicative of the unoccupied condition of the track section B. The phase comparator 37 compares the rate code modulated 100 HZ applied as an input on line 36 with steady 100 HZ energy obtained over wires 50 and 51 from line wires 25 and 26 connected to the phase comparator in opposite instantaneous polarity relationship to the phase assigned to the code transmitter 10B for the associated track section. Thus, the rate coded 100 HZ alternating current input on line 36 is compared with steady 100 HZ alternating current energization of the opposite phase relationship in the phase comparator 37.

These inputs cancel each other when they are simultaneously received by the phase comparator 37 during "on" periods of a rate code received. During the "off" periods of the rate code received, the steady energization of the 100 HZ input, at a time when there is no input on line 36, generates a D.C. pulse output of the phase comparator 37. Thus, the phase comparator 37 delivers an output on output line 52 that is proportional to the difference in phase between the input on line 36 and the steady 100 HZ reference voltage. There must be some allowable phase difference because of normal phase variations which occur due to ballast variations and the like. Thus, the output of line 52 is fed through a level detector 53 to compare this output with an allowable phase difference as determined by the parameters of the level detector 53. Therefore, output of the level detector 53 on line 54 is zero during "on" periods of the code received, provided that the track voltage is substantially in proper phase.

The out-of-phase pulses (during "off" periods of the rate code) drive set inputs of a flip-flop 55 over line 54, the flip-flop 55 being reset at the end of each "off" period over line 56 from the driver 43. This reproduces the rate code received as a rate code output on line 57, which is applied as an input to a low pass filter 58. The low pass filter 58 provides a rate code output over line 59 for energizing track relay TR through a driver 60, only provided the input over line 57 to the low pass filter 58 is a wave form substantially reproducing the rate of rate codes for which the low pass filter 60 is designed to pass. Thus, for example, there is no output on line 59 of the low pass filter 58 if the alternating current received is sufficiently out-of-phase so that the flip-flop 55 is set for only a very short portion of the cycle of the rate code.

It will be readily apparent from the description of the receiver 11B of FIG. 1, that the track relay TR is energized whenever the associated track section B is unoccupied by a vehicle, irrespective of the rate code being communicated, provided that the track energy is substantially in its assigned phase relationship relative to the line circuit. Thus, if a 75 rate code is being received, only the relay TR is picked up, while the reception of a 120 or 180 rate code provides that the additional corresponding relay 120R or 180R is picked up. This obviously provides three distinctive controls that can be used in the conventional manner for signalling purposes.

With reference to FIG. 2, circuits are illustrated for modulator 17 and zero crossing detector 21 of the typical code transmitter 10B. The modulator 17 has a flip-flop 61 that has set and reset inputs that are governed jointly by switching transistors Q1 and Q2 which are alternately switched on and off by the rate code pulses applied as an input to the modulator 17 over line 16 from the code selector logic 15 (see FIG. 1). The setting of flip-flop 61 is enabled over input wire 62 by the switching transistor Q1, and the reset of flip-flop 61 is enabled over wire 63 by the switching transistor Q2. The setting and resetting of the flip-flop 61 is driven, however, over wire 19 when a transistor Q4 in the zero crossing detector 21 is turned on. This occurs during the zero crossing condition of the 100 HZ alternating current supply applied to the zero crossing detector 21 over wires 23 and 24 from the line wires 25 and 26. This energy is applied to a transformer 64 that is used jointly for the zero crossing detector 21 and to provide the modulated alternating current supply through power amplifier 38 for the track circuit. The transformer 64 has a secondary winding 65 having a center tap 66 connected to common, both sides of the center tapped winding 65 being connected to the base of transistor Q3 through diodes 67 and 68 respectively. This causes Q3 to be turned on except at zero crossover. Thus at zero crossover, Q3 being turned off, permits Q4 to conduct and apply enabling energy over line 19 to modulator 17. Thus the flip-flop 61 shifts when enabled by energy on line 19 in combination with switching transistors Q1 and Q2 which are alternately turned on to deliver rate code pulse output on line 22.

The output of modulator 17 on line 22 is applied to the base of a transistor Q5 that is pulsed on and off to alternately shunt the connection over wire 69 to the lower terminal of the secondary winding 65 of transformer 64 to common through wire 70. When the shunt is removed, output is applied on wires 27 of 100 HZ alternating current from the secondary winding 65 of transformer 64 which is connected across a resistor 71 at this time. Thus the pulsing of the 100 cycle A.C. supply for transmission through the track rails is accomplished with minimum noise generated because of switching at zero crossing times of the 100 HZ A.C. supply.

It will be apparent that the phase sensitive part of the receiving apparatus as described is particularly adapted for use of conventional electronic components as compared to the relay system of the above mentioned U.S. Staples Pat. No. 2,884,516 which requires the use of a code following relay and does not have electronic components for improving the sensitivity, such as level detector 53 and low pass filter 58.

Having thus described an alternating current track circuit system having improved transmitting and receiving apparatus as a preferred embodiment of the present invention, it is to be understood that various modifications and alterations may be made to the specific embodiment shown without departing from the spirit or scope of the invention.

What is claimed is:

1. Alternating current track circuits for several adjoining track sections of a stretch of railway track, each of the track circuits comprising an alternating current code transmitter and an alternating current code receiver connected to track rails at opposite ends of an associated section for detecting track occupancy, for communicating signal control rate codes through the track rails and for detecting broken down insulating rail joints which may be used to define boundaries of the several track sections, wherein improvements in the track circuit for each track section comprise;

a. circuit means including an alternating current line circuit extending along the stretch of railway track for normally communicating alternating current from the line circuit at a selected modulated rate code through rails of the associated track sections, current in any two adjoining track sections being of opposite instantaneous polarity for broken down joint protection, and b. the circuit means comprising means responsive to the rate coded alternating current communicated through the track rails for governing energization of a track relay comprising,

1. phase sensing means including comparator means for comparing the rate code modulated alternating current communicated through the track rails with a steady reference source connected to the line circuit and for generating an output rate code pattern comparable to modulations in the track rails only provided that the alternating current in the track rails is substantially 180° out-of-phase with the reference source of the associated track circuit, and 2. means including a flip-flop circuit and a low pass filter for energizing the track relay only in response to the direct current rate code pattern output of the phase sensing means.

2. Alternating current track circuits according to claim 1 wherein the circuit means for normally communicating rate code modulated alternating current comprises a zero crossing detector for switching the alternating current applied to the track rails alternately on and off substantially at zero current points in cycles of the alternating current, whereby time spaced pulses of alternating current are formed at a selected rate for communication over the track rails while keeping generation of harmonic frequencies to a minimum.

3. Alternating current track circuits according to claim 1 wherein the phase sensing means comprises level detection means for permitting energization of the track relay only provided output of the phase comparator is above a fixed minimum level.

4. Alternating current track circuits according to claim 3 wherein the flip-flop circuit is set by output of the level detection means and is reset by the beginning of each rate code pulse delivered over the track rails for generating the code pattern output of the phase sensing means.

5. Alternating current track circuits according to claim 1 wherein means is provided for selecting one of a plurality of rate codes for communication through the track rails, and decoding means is provided for each of the rate codes communicated through the track rails including a code responsive relay.

* * * * *